US011505883B2

(12) United States Patent
Haynes

(10) Patent No.: US 11,505,883 B2
(45) Date of Patent: Nov. 22, 2022

(54) METHODS OF MAKING COMPOSITE NONWOVEN WEBS

(71) Applicant: Kimberly-Clark Worldwide, Inc., Neenah, WI (US)

(72) Inventor: Bryan D. Haynes, Cumming, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 413 days.

(21) Appl. No.: 16/623,690

(22) PCT Filed: Jun. 29, 2018

(86) PCT No.: PCT/US2018/040191
§ 371 (c)(1),
(2) Date: Dec. 17, 2019

(87) PCT Pub. No.: WO2019/006242
PCT Pub. Date: Jan. 3, 2019

(65) Prior Publication Data

US 2020/0157717 A1 May 21, 2020

Related U.S. Application Data

(60) Provisional application No. 62/527,326, filed on Jun. 30, 2017.

(51) Int. Cl.
*D01D 5/08* (2006.01)
*D01D 5/088* (2006.01)
(Continued)

(52) U.S. Cl.
CPC ..... *D04H 1/56* (2013.01); *D01D 5/0985* (2013.01); *D04H 1/492* (2013.01); *D04H 1/732* (2013.01);
(Continued)

(58) Field of Classification Search
CPC ..... D01D 5/08; D01D 5/088; D01D 5/098; D01D 5/0985; D01D 7/00; D04H 1/425; D04H 1/56; D04H 1/1732; D04H 5/06
(Continued)

(56) References Cited

U.S. PATENT DOCUMENTS 3,797,074 A 3/1974 Zafiroglu
3,923,587 A 12/1975 Porte
(Continued)

FOREIGN PATENT DOCUMENTS

GB 2178433 B 7/1989
WO 05045116 A1 5/2005

OTHER PUBLICATIONS

Lotte Chemical, "Non-woven Fabric", Technology Guide, http://english.lottechem.com/contents/product/technology_05.asp.

*Primary Examiner* — Leo B Tentoni

(57) ABSTRACT

Disclosed herein are improvements to processes and equipment for the manufacture of composite nonwoven webs comprising a mixture of two or more different fibers and formed from at least two streams of air-entrained fibers. Adjacent the perimeter of an exit port of one of the fiber streams are located a series of spaced tabs and apertures. As a first stream of air-entrained fibers pass the series of tabs and apertures, vortices are formed therein. When mixed with a second stream of air-entrained fibers, the vortices within the first stream of fibers causes increased mixing of the fibers, helping to drive the first fibers deeper into the second stream of air-entrained fibers.

20 Claims, 4 Drawing Sheets

(51) Int. Cl.

| | |
|---|---|
| ***D01D 5/098*** | (2006.01) |
| ***D01D 7/00*** | (2006.01) |
| ***D04H 1/425*** | (2012.01) |
| ***D04H 1/56*** | (2006.01) |
| ***D04H 1/492*** | (2012.01) |
| ***D04H 1/732*** | (2012.01) |
| ***D04H 5/06*** | (2006.01) |

(52) U.S. Cl.
CPC ..... *D04H 5/06* (2013.01); *D10B 2201/01* (2013.01); *D10B 2321/022* (2013.01)

(58) Field of Classification Search
USPC ..... 264/103, 172.19, 211.12, 211.14, 517, 264/518, 555
See application file for complete search history.

(56) References Cited

U.S. PATENT DOCUMENTS

| | | | | |
|---|---|---|---|---|
| 3,978,185 | A | 8/1976 | Buntin et al. | |
| 4,426,417 | A | 1/1984 | Meitner et al. | |
| 4,707,398 | A | 11/1987 | Boggs | |
| 4,929,480 | A * | 5/1990 | Midkiff | B65D 81/264 428/36.2 |
| 5,350,624 | A | 9/1994 | Georger et al. | |
| 5,695,377 | A | 12/1997 | Triebes et al. | |
| 5,766,646 | A | 6/1998 | Geus et al. | |
| 5,935,612 | A | 8/1999 | Triebes et al. | |
| 6,001,303 | A | 12/1999 | Haynes et al. | |
| 6,019,152 | A * | 2/2000 | Haynes | D04H 3/14 264/109 |
| 6,117,379 | A * | 9/2000 | Haynes | D01D 5/0985 425/464 |
| 6,247,911 | B1 | 6/2001 | Milligan | |
| 6,319,865 | B1 | 11/2001 | Mikami | |
| 6,457,654 | B1 | 10/2002 | Glezer et al. | |
| 6,548,431 | B1 * | 4/2003 | Bansal | D04H 3/14 442/361 |
| 6,663,823 | B2 | 12/2003 | Kobayashi et al. | |
| 6,709,623 | B2 | 3/2004 | Haynes et al. | |
| 7,150,616 | B2 | 12/2006 | Haynes et al. | |
| 7,320,581 | B2 | 1/2008 | Allen et al. | |
| 7,488,441 | B2 | 2/2009 | Haynes et al. | |
| 7,504,060 | B2 | 3/2009 | Brock et al. | |
| 7,581,376 | B2 | 9/2009 | Simmonds | |
| 7,628,941 | B2 | 12/2009 | Krause et al. | |
| 7,682,554 | B2 | 3/2010 | Venturino et al. | |
| 7,687,012 | B2 | 3/2010 | Daniels et al. | |
| 8,017,066 | B2 | 9/2011 | Hartge | |
| 8,246,898 | B2 | 8/2012 | Conrad et al. | |
| 8,333,918 | B2 | 12/2012 | Lennon et al. | |
| 8,685,311 | B2 | 4/2014 | Koyama et al. | |
| 9,480,375 | B2 | 11/2016 | Marshall et al. | |
| 2003/0200991 | A1 | 10/2003 | Keck et al. | |
| 2005/0148261 | A1 | 7/2005 | Close et al. | |
| 2007/0141934 | A1 | 6/2007 | Sayre et al. | |
| 2008/0026173 | A1 | 1/2008 | Angadjivand et al. | |
| 2008/0160856 | A1 * | 7/2008 | Chen | D04H 1/43838 442/341 |
| 2010/0081352 | A1 | 4/2010 | Westwood | |
| 2010/0289169 | A1 | 11/2010 | Jezzi | |
| 2012/0171919 | A1 | 7/2012 | Jackson et al. | |

* cited by examiner

METHODS OF MAKING COMPOSITE NONWOVEN WEBS

This application claims priority from U.S. provisional Patent Application Ser. No. 62/527,326 filed on 30 Jun. 2017, the entire contents of which are incorporated herein by reference.

FIELD OF INVENTION

The present invention relates to methods of making coherent nonwoven webs comprising a mixture of two or more different fibers.

BACKGROUND

Various different methods are known in the art with regard to the formation of nonwoven webs. For example, nonwoven webs are known to be made from various processes such as spunbonding, meltblowing, hydroentangling, carding and so forth. In addition, many of these processes can be adapted so as to form nonwoven webs having combinations of different fibers. For example, as is generally known, different streams of fibers can be introduced together and co-mingled to some degree as described in U.S. Pat. No. 5,350,624 to Georger; U.S. Pat. No. 5,853,635 Morell et al., U.S. Pat. No. 6,263,545 Pinto, and so forth. However, the degree and/or nature of mixing is not easily controlled when bringing distinct streams of fibers together at high rates. While more aggressive mixing of fibers can be achieved by changing the angle of impingement, velocity and other aspects of the fiber streams, often times such process conditions can also negatively impact other attributes of the formed web such as softness, strength, integrity, etc. Thus, there is a need for an improved process that allows for greater control over the mixing of distinct fiber streams yet does so without sacrificing other desired attributes of the formed nonwoven web.

Therefore, the present invention provides a process of inter-mixing different streams of fibers that drives greater mixing of fibers and that can be readily adapted to modify the degree and/or nature of mixing to be achieved for a given process.

SUMMARY OF THE INVENTION

The improved method of the present invention includes utilizing a chute having first and second opposed walls that define a passageway and an exit gap and further having a series of spaced tabs extending outwardly adjacent the exit gap perimeter. The tabs may have a width of between about 0.5 and about 10 cm and, between the tabs, an aperture or open space whereby air is allowed to flow sidewardly relative to the to the direction of passageway. First fibers are entrained in a first stream of air and directed downwardly through the chute at a high velocity and out of the chute through the exit gap and adjacent tabs. As the air-entrained first fibers pass the series of tabs and apertures, vortices are formed within the air-entrained first fibers. Second fibers are separately entrained within a stream of air and, immediately below the exit gap, are directed to impinge upon the first stream of air-entrained fibers wherein the second fibers and first fibers inter-mix and form a composite stream of air-entrained fibers. The formation of the vortices within the first stream of fibers acts to cause increased mixing of the fibers, helping to drive the first fibers deeper into the air-entrained stream of second fibers. Thereafter, the composite stream of air-entrained fibers are deposited onto a foraminous forming surface thereby forming a nonwoven web.

DETAILED DESCRIPTION

Throughout the specification and claims, discussion of the methods, articles and/or individual components thereof is with the understanding set forth below.

(i) The term "comprising" or "including" or "having" are inclusive or open-ended and do not exclude additional unrecited elements, compositional components, or method steps. Accordingly, the terms "comprising" or "including" or "having" encompass the more restrictive terms "consisting essentially of" and "consisting of."

(ii) As used herein "continuous fibers" means fibers formed in a continuous, uninterrupted manner having a substantially indefinite length and having a high aspect ratio (length to diameter) in excess of 10,000:1.

(iii) As used herein "staple length fibers" means continuous synthetic fibers cut to length or natural fibers, such fibers having a length between about 0.5 mm and about 60 mm. The length of such fibers being that of the straight (e.g. uncontorted) fiber.

(iv) As used herein, unless expressly indicated otherwise, when used in relation to material compositions the terms "percent" or "%" each refer to the quantity by weight of a component as a percentage of the total.

(v) As used herein the term "cellulosic" means those materials comprising or derived from cellulose including natural or synthetic cellulose as well as that derived from both woody and non-woody sources.

(vii) As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

(vii) As used herein "propylene polymer" means a polymer having greater than 50% propylene content.

(viii) As used herein, the term "nonwoven web" means a structure or a web of material that has been formed without use of traditional fabric forming processes such as weaving or knitting, to produce a structure of individual fibers or threads that are entangled or intermeshed, but not in an identifiable, repeating manner.

(ix) As used herein, the term "machine direction" or "MD" refers to the direction of travel of the forming surface onto which fibers are deposited during formation of a fibrous web.

(x) As used herein, the term "cross-machine direction" or "CD" refers to the direction which is essentially perpendicular to the machine direction defined above.

Vortex Generator

Figure 1:
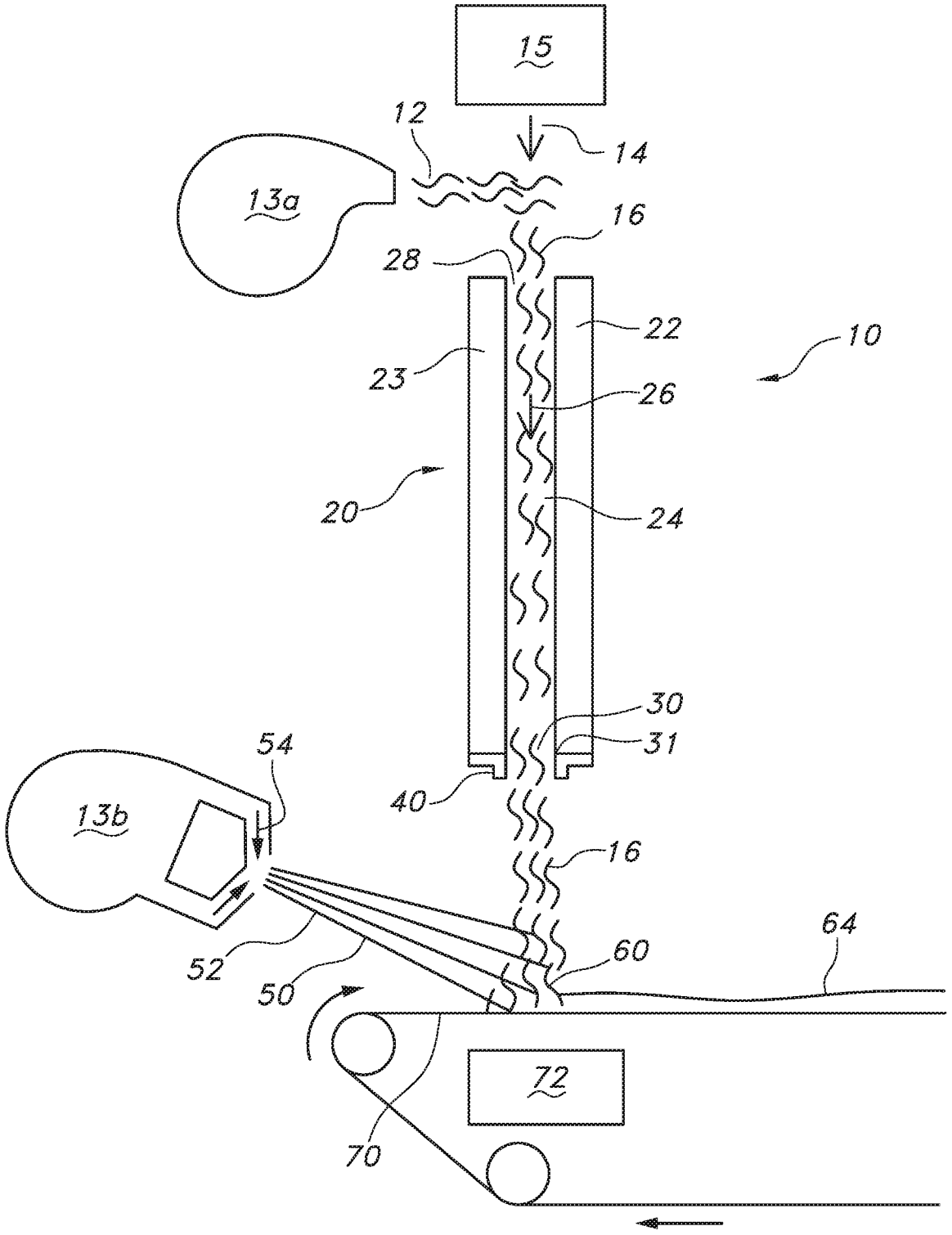
FIG. 1 is a side view of a system for making a composite nonwoven web according to the present invention.

As shown in reference to the schematic representation of FIG. 1, a system 10 is shown for use in practicing the method of the present invention. A nozzle or chute 20 is provided having a first wall 22 and a second wall 23 that defines a passageway 24 and a passageway direction 26 (i.e. the direction in which the air and air-entrained fibers travel downwardly through the chute). While two walls are shown for ease of reference, it will be readily appreciated that they system can have additional opposed walls and provide a chute that is fully enclosed along its height. With respect to closed chute systems, typically the passageway would have a rectangular configuration and in such respect the first and second walls referenced herein would correspond to the longer walls defining the rectangular chute and that extend in the cross-direction. The length of the first and second walls, i.e. the length extending in the cross-direction, can vary significantly including for example having lengths between about 0.5 and about 5 M or even between about 1M and about 3 M. The height of the walls 22, 23, i.e. the length of the passageway 24 spanning the feed gap 28 and exit gap 30, can be about 4 M or less. The passageway 24 has a feed gap 28, where the fiber stream is introduced into the passageway 24, and an exit gap 30 where the fiber stream exists the passageway 24. The exit gap 30 can have a gap width, i.e. the distance between the first and second walls 22, 23, of between about 0.5 cm and about 15 cm. It will be readily understood that, in a fully enclosed chute, third and fourth walls extending in the machine direction would span the gap between and the first and second walls and be adjoined therewith to define the perimeter of the chute.

Figure 2:
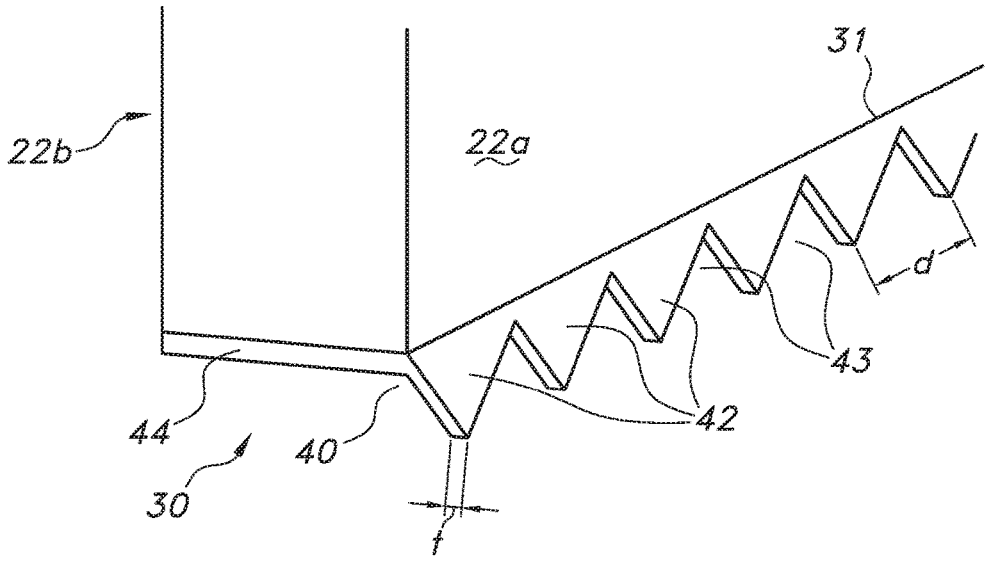
FIG. 2 is a perspective view of a vortex generator for use in the present invention.

Adjacent the exit gap 30 is a vortex generator 40. As best seen in relation to FIGS. 2 and 3, the vortex generator comprises a series of spaced tabs 42 adjacent the perimeter 31 of the exit gap 30. The tabs 42 extend outwardly parallel or substantially parallel with the passageway direction 24. In one aspect, the tabs may extend at an angle +/−45 degrees relative to the passageway direction 26, between about +/−30 degrees relative to the passageway direction 26 or between +/−15 degrees relative to the passageway direction 26. In certain embodiments, the tabs may be hinged or adjustable such that their angle relative to the passageway direction may be easily changed. In certain embodiments, the tabs may be positioned to be flush with the exit gap 30 or inner wall 22*a* of the chute. Alternatively, the tabs may be positioned slightly back from the perimeter of the exit gap 30. In certain embodiments, the tabs can be positioned so as to be flush with the perimeter of the exit gap (i.e. flush with the inner walls 22*a*) and are angled such that they either extend (i) parallel with the passageway direction, (ii) parallel with the plane of the adjacent passageway inner wall, (iii) outwardly, such as away from the plane of the adjacent passageway inner wall or away from the first stream, or (iv) inwardly, such as away from the outer wall or towards the first stream. In still further embodiments, the base of the tabs may be positioned slightly outwardly or back from the exit gap perimeter and either extend (i) parallel with the passageway direction, (ii) parallel with the plane of the adjacent passageway inner wall, (iii) outwardly, such as away from the plane of the adjacent passageway inner wall or away from the first stream, or (iv) inwardly, such as towards from the plane of the adjacent passageway inner wall or towards the first stream. Desirably, the location of the tabs beneath exit gap and the tab angles are selected such that that they do not extend directly into the flow of the first stream of air-entrained fibers and/or do not extend inwardly of planes of the inner walls of the passageway. In a particularly desirable embodiment, the tabs extend outwardly from the walls such that they are both flush with the CD extending walls 22 and/or 23 and extend parallel with the passageway direction 26. While tabs are shown as extending from both the first and second opposed walls, it will be appreciated that the tabs can optionally be positioned adjacent only one of the walls. The vortex generator, including the tabs, desirably extend along the entire CD length of the walls although can optionally extend over less than the entire length of the walls, e.g. the tabs can extend along greater than 60%, 70%, 80% or even 90% of the bottom of the walls in the CD direction. For example, the vortex generator and/or tabs can extend between about 60-100%, 70-100%, 80-100% or even 90-100% of the bottom of the CD extending walls forming the passageway and/or chute.

Figure 3A:
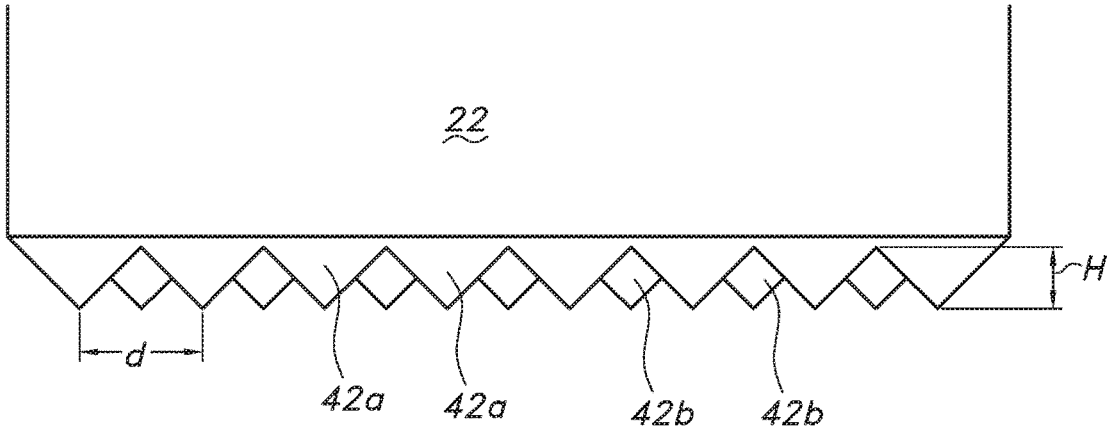
FIGS. 3A, 3B and 3C are side views of different vortex generators as seen from the machine direction.
Figure 3B:
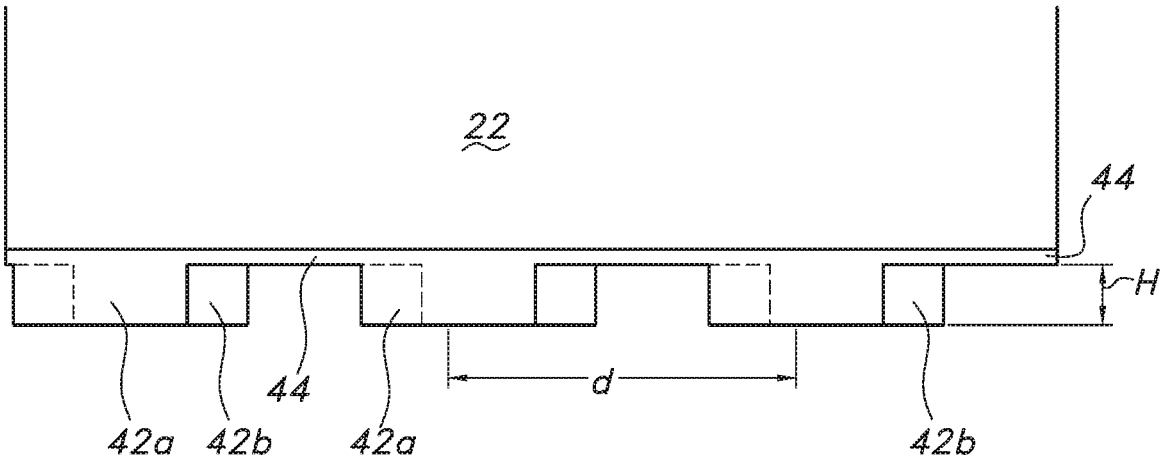
Figure 3C:
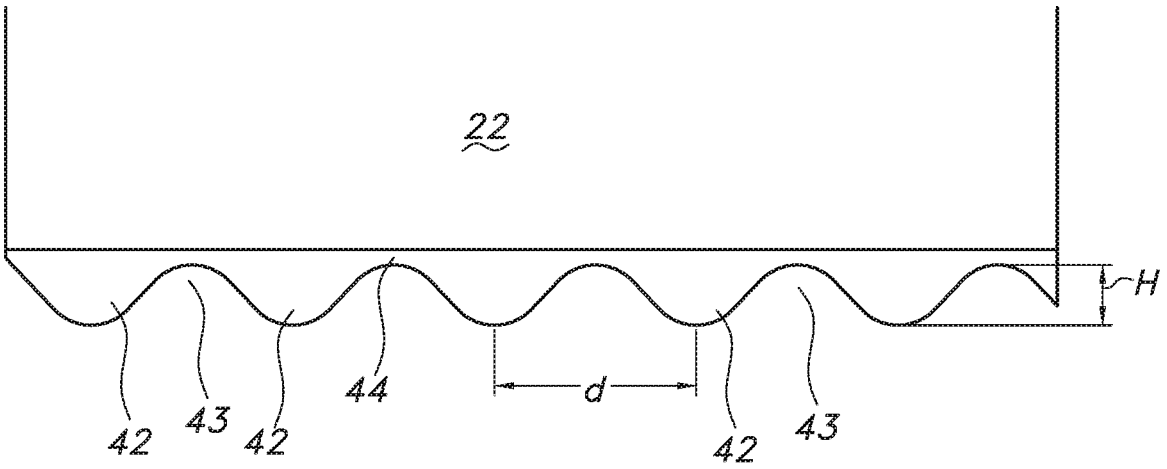

The tabs can have one or more different shapes including triangular, Reuleaux triangular, square, rectangular, semi-circle, semi-elliptical or other geometric or curvilinear shapes. For example, triangular shaped tabs 42 are shown in FIG. 3A, rectangular shaped tabs 42 are shown in FIG. 3B and sinusoidal shaped tabs 42 are shown in FIG. 3C. In a further aspect, the series of such shaped tabs can be presented in a regular and repeating fashion having identical size and shaping; such structure would present a generally wave-like structure such as a sine wave, triangular wave, square wave, rectangular wave, etc. However, the tabs need not have identical size and/or shape. In certain embodiments, the tab shape will have one or more sharp corners as opposed to rounded features; for example the corners such as formed from triangular or square shaped tabs. In certain embodiments, the tab shape may have one or more corners, having an internal angle where the two sides meet, greater than about 30, 35, 40 or 45 degrees and less than about 110, 100, 90 or 85 degrees. Further, the tabs on opposed walls can be aligned in the MD, staggered (partially off-set) or offset completely relative to one another. For example, in reference to FIG. 3A, tabs 42*a* extending below first wall 22 are fully off-set from tabs 42*b* extending below the opposed second wall 23 (not shown). Still further, and in reference to FIG. 3B, tabs 42*a* extending below first wall 22 are partially off-set from tabs 42*b* extending from opposed second wall 23 (not shown). Further in reference to FIG. 3B, tabs 42*a* extending below first wall 22 are partially aligned with tabs 42*b* extending from opposed second wall (not shown); in other words the tabs are partially off-set from one another as seen from the MD. In reference to FIG. 3C, in this embodiment the tabs 42 on both on the opposed CD extending walls are fully aligned in the MD and hence the opposed tab on the opposite wall cannot be seen. In such an embodiment the apertures 43 beneath the opposed walls are aligned in the MD and can be fully unoccluded in the MD direction on both sides. Still further, in certain embodiments, the edge of the tab, forming the overall or macro shape, may itself have microshapes therein such as having a micro-sinusiodal, scalloped, crenulated or serrated edges; e.g. a double serrated edge.

In certain embodiments, the tabs 24 can have a height (h) between about 0.2 and about 4 cm, or between about 0.3 and about 2 cm, or even between about 0.5 cm and about 1.5 cm. The height (h) is the distance measured from the peak of the tab to lowest point in the flume or trough. The spacing of the tabs will typically be influenced by their height, thus in certain embodiments the center-to-center spacing (d) can be between about 0.75 and about 5 times the height or even between about 1 and about 3 times the height. By way of example, in certain embodiments the tabs can have a center-to-center or spacing (d) of between about 0.4 to about 10 cm, or between about 0.6 to about 8 cm or even between about 1 cm and about 3 cm. In addition, in certain embodiments, the tabs can have a thickness (t) as measured in the MD that is substantially the same as or less than that of the CD extending walls of the chute. For example, the tabs can be less than about 90%, 50%, 30%, 10% or 5% of the thickness of the CD extending walls of the chute. In certain embodiments, the tabs can have a thickness of between about 0.5 mm and about 30 mm although desirably the tabs will be relatively thin such as having a thickness between about 0.8 mm and 5 mm. Between the tabs are apertures or flumes 43 that allow movement of air generally orthogonal to the passageway direction 26 and/or parallel to the MD.

The vortex generator may be attached to the walls by one or more means known in the art such as, for example, through the use of adhesive, welds, bolts, screws or other fasteners. For ease of attachment and fabrication, and as best seen in reference to FIG. 2, the vortex generator may have a base 44 adjacent the bottom of the channel wall and that extend behind the tabs 42. The base 44 extends outwardly or away from the inner walls 22*a* towards the opposed outer walls 22*b*. However, it is important that the base or other elements not occlude the open spaces 43 located between the individual tabs 42. In this regard, the unoccluded space adjacent and behind the tabs allows air to travel between the tabs in a direction generally sidewardly or orthogonal relative to the to the passageway direction. It is believed that as the first stream of air-entrained fibers pass the tabs, the air-entrained fibrous stream adjacent the apertures starts to expand just prior to the air-entrained fibrous stream adjacent the tabs, resulting in rotational energy and movement that in-turn drives more aggressive or better mixing with additional fibers introduced immediately below the vortex generator.

System and Method of Making the Composite Nonwoven

As shown in reference to FIG. 1, a schematic representation of an apparatus or system 10 is shown for use in practicing the method of the present invention. A stream of first fibers 12 are introduced into a first stream of air 14 generated by a blower 15, e.g. fan, jet or other like apparatus. The stream of air 14 picks-up and/or carries the first fibers 12 and forms a first stream of air-entrained fibers 16. The first fibers 12 can be introduced into the process by one or more fiber generators 13*a*. In this regard, the fibers can be manufactured in-line or can be previously manufactured and separated for introduction into the process. With respect to pre-made fibers, equipment such as a picker, hammer-mill, or like equipment may be used to separate and introduce the individual fibers into the air stream. Alternatively, the fibers may be made in-line.

The first stream of air-entrained fibers 16 is directed into the chute 20 via the entrance gap 28. The velocity of the first fibers as they exit the chute via the exit gap 30 and pass the vortex generator 40 is at least 50 M/second such as, for example, being between about 50 M/second and about 200 M/second. Upon exiting the exit gap 30 and passing adjacent and past the vortex generator 40, the first stream of air-entrained fibers 16 will continue until impinged upon by a second stream of air-entrained fibers 50. Second fibers 52 are picked-up and/or carried by a second stream of air 54, generated by a second blower 13*b*, and the second stream of air-entrained fibers 50 is directed towards the path of the first stream 16. The first and second streams 16, 50 intersect and the momentum and motion of the respective streams cause the first and second fibers 12, 52 to intermix and thereby form a composite stream 60 comprising a mixture of both the first and second fibers 12, 52. As noted above, the degree of mixing is enhanced in the MD and/or CD directions as a result of the additional lateral and/or rotational movement of the first fibers 12 imparted by the vortex generator 40. However, it will be noted that the degree and nature of the fiber mixing may be further influenced by additional aspects of the process such as, for example, controlling the angle of impingement, air speeds, air temperature, forming distance and other aspects of the process. In certain embodiments, the impingement angle, i.e. the direction of the second fiber stream relative to the direction of the first fiber stream, can be between about 90° and about 20° or between about 80° and 35° or even between about 60° and 40°

The composite stream 60 is directed towards a forming surface 70. The forming surface 70 can comprise any one of numerous known forming surfaces such as for example a belt, wire, fabric, drum and so forth. Typically, it will be desirable for the forming surface to be foraminous. Where it is desired for the resulting nonwoven web to have additional texture, a forming surface having a desired topography may be used such as for example the forming surfaces described in U.S. Pat. No. 5,575,874 to Griesbach et al., U.S. Pat. No. 6,790,314 to Burazin et al., U.S. Pat. No. 9,260,808 to Schmidt et al. and so forth. As is common for continuous manufacturing processes, the forming surface is moved laterally under the chute and flowing streams of fibers. The rate that the fibers are introduced, e.g. mass of fibers streamed or extruded per second, is selected in combination with the speed of the forming surface, i.e. M/second, to achieve a nonwoven having the desired basis weight. Aiding with the drawing of the composite fiber stream 60, and the collection of the airflows, is one or more vacuums 72 positioned under the forming surface 70 such that the forming surface 70 is between the chute 20 and the vacuum 72. The vacuum helps draw the fibers onto the forming surface as well as draws the entraining air through the forming surface and collects the same to prevent it from dislodging or impacting the fibers once deposited.

Once deposited onto the forming surface 70, a nonwoven web 64 is formed thereon. In certain embodiments, the nonwoven web as deposited may have the desired degree of integrity without any further treatments such as in instances where the second fibers are introduced into the impingement region when still semi-molten. In instances where additional web integrity is needed and/or desired, the web may be treated in one or more ways to increase the degree of fiber entanglement, such as by hydroentangling, or to generate fiber-to-fiber bonding, such as through the use of adhesives, thermal bonding and so forth. In certain embodiments, the inter-fiber bonding may be achieved autogenously where thermoplastic fibers are employed. For example, where bicomponent or binder fibers are included within one of the fiber streams, after the nonwoven web has been deposited, it can be heated to a temperature at or above the melting point of the binder fibers or low melting component in order to create bonds at the fiber contact points. In still other embodiments, additional bonding and increased web integrity may be achieved through the formation of thermal point bonding. In this regard, as is known in the art, the nonwoven may be passed through a nip formed by a pair of embossing rolls, wherein at least one of the rolls has a pattern of protuberances or "pins" corresponding to the desired pattern of bond points. Bonding may be used as desired to increase web integrity as well as create desired aesthetics and/or textural features in the web. By way of example only, various embossing methods are shown and described in U.S. Pat. No. 3,855,046 to Hansen et al.; U.S. Pat. No. 5,620,779 issued to Levy et al; U.S. Pat. No. 6,036,909 to Baum; U.S.

Pat. No. 6,165,298 to Samida et al.; U.S. Pat. No. 7,252,870 to Anderson et al. and so forth. The total embossed area will generally be less than about 50% of the surface area of the nonwoven web and more desirably will be between about 2% and about 30% of the web or even between about 4% and about 20% of the web.

Figure 4:
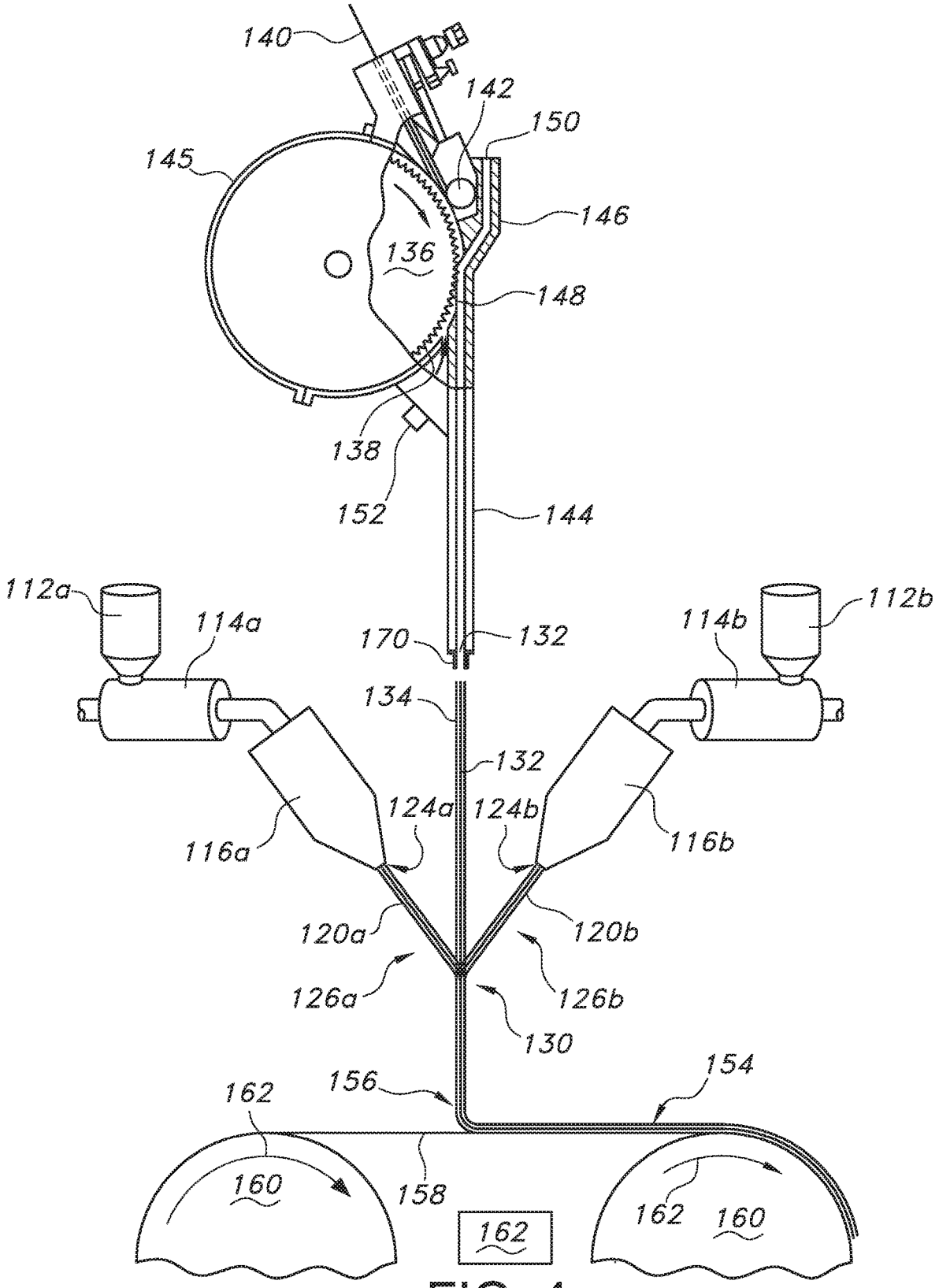
FIG. 4 is a side view of a system employing a vortex generator of the present invention.

In one particular aspect, and in reference to FIG. 4, the vortex generator and process of the present invention may be employed in the manufacture of a composite nonwoven web comprising a mixture of meltblown fibers and staple length fibers. In such a process, at least one meltblown die head is arranged near the chute exit. Preferably two meltblown die heads are employed, such as being positioned on opposed sides of the fiber stream exiting the chute. By way of non-limiting example, suitable processes and techniques for forming such composite webs are described in U.S. Pat. No. 4,100,324 to Anderson, et al.; U.S. Pat. No. 5,350,624 to Georger, et al.; and US Patent Application Publication Nos. 2003/0200991 to Keck, et al., 2007/0049153 to Dunbar, et al., and 2009/0233072 to Harvey et al., all of which are incorporated herein in their entirety by reference to the extent consistent herewith.

The staple length fibers, such as pulp fibers, may be introduced into the chute 144 using equipment such as a picker roll 136 arrangement having a plurality of teeth 138 adapted to separate a mat or batt 140 of fibers into the individual staple length fibers. Fibers can also, as is well known, be introduced from bales (not shown). When employed, the sheets or mats 140 of fibers are fed to the picker roll 136 by a roller arrangement 142. After the teeth 138 of the picker roll 136 have separated the mat of fibers into separate staple length fibers (not shown), the individual fibers are conveyed through a chute 144. A housing 145 encloses the picker roll 136 and provides a passageway or gap 148 between the housing 145 and the surface of the teeth 138 of the picker roll 136. An air stream is supplied to the passageway or gap 148 between the surface of the picker roll 136 and the housing 146 by way of an air duct 150. The air duct 150 directs air downwardly through the gap 148 entraining individual fibers into the chute 144. The air supplied from the duct 150 serves to entrain lose fibers in the gap 148 and also remove fibers from the teeth 138 of the picker roll 136. A second air stream is introduced via air duct 152 that helps ensure that fibers are removed from the picker teeth and directed back into the gap 148 and air-stream entering the top of the chute 144. The air supplies are selected to have sufficient quantity and speed to ensure that fibers are effectively removed from the teeth of the picker and also that the entrained fibers are directed into and downwardly through the chute 144. The air may be supplied by any conventional arrangement such as, for example, an air blower (not shown). It is contemplated that additives and/or other materials may be added to or entrained in the air stream together with the individual fibers or to treat the fibers.

Still in reference to the embodiment shown in FIG. 4, a thermoplastic polymer composition may be introduced into extruders 114*a* and 114*b* from corresponding pellet hoppers 112*a* and 112*b*. The extruders 114*a* and 114*b* each have an extrusion screw (not shown), which is driven by a conventional drive motor (not shown). As the polymer advances through the extruders 114*a* and 114*b*, it is progressively heated to a molten state due to rotation of the extrusion screw by the drive motor. Heating may be accomplished in a plurality of discrete steps with its temperature being gradually elevated as it advances through discrete heating zones of the extruders 114*a* and 114*b* toward two meltblowing dies 116*a* and 116*b*, respectively. The meltblowing dies 116 and 118 may be yet another heating zone where the temperature of the thermoplastic resin is maintained at an elevated level for extrusion.

When two or more meltblowing die heads are used, such as described in relation to this embodiment, it should be understood that the fibers produced from the individual die heads may themselves be different types of fibers. That is, one or more of the size, shape, or polymeric composition may differ, and furthermore the fibers may be monocomponent or multicomponent fibers. Alternatively and/or additionally, each die head can extrude approximately the same amount of polymer per unit of time or, as desired, one die head may have a higher extrusion rate than the other such that the proportion of fibers varies by side. Stated differently, in certain embodiments it may also be desirable to have the relative basis weight production skewed, such that one die head or the other is responsible for the majority of the meltblown fibers contained within the composite nonwoven web.

As is known with respect to the formation of meltblown fibers, high velocity streams of air attenuate the melt-extruded fibers 120*a*, 120*b* exiting the die 116*a*, 116*b*. Each meltblowing die 116*a*, 116*b* is positioned so that two streams of attenuating air per die converge to form a single stream of air which entrains and attenuates molten threads 120*a*, 120*b* as they exit small holes or orifices 124*a*, 124*b* in each meltblowing die. The molten threads 120*a*, 120*b* are formed into fibers usually less than the diameter of the orifices 124. Thus, each meltblowing die 116*a* and 116*b* has a corresponding single stream 126*a* and 126*b* of air-entrained thermoplastic polymer meltblown fibers. The streams of air-attenuated meltblown fibers 126*a* and 126*b* containing polymer fibers are directed to converge at an impingement zone 130. Typically, the meltblowing die heads 116*a* and 116*b* are arranged at an acute angle with respect to the staple fiber stream 134 exiting the chute 144.

The first stream 134 of air-entrained staple fibers, having been directed through the chute 144 and past the exit gap 132 and vortex generator 170, is impinged upon by the two streams 126*a* and 126*b* of thermoplastic polymer meltblown fibers 120*a* and 120*b*, respectively, at the impingement zone 130. By merging the first stream 134 containing the staple fibers between the two streams 126*a* and 126*b* of thermoplastic polymer meltblown fibers 120*a* and 120*b*, all three gas streams converge in a controlled manner and create an intermixed composite stream 156. However, often the fiber streams are not uniformly mixed and instead a gradient structure is obtained. Also, because the meltblown fibers 120*a*, 120*b* remain relatively tacky and semi-molten after formation, the meltblown fibers 120*a* and 120*b* can simultaneously adhere and entangle with the staple fibers upon contact therewith to form a coherent nonwoven structure upon deposition without the need for additional bonding or treatment.

To convert the composite stream 156, comprising the combined stream of air-entrained thermoplastic polymer fibers 126*a*, 126*b* and air-entrained staple fibers 134, into a fully coherent composite nonwoven structure 154, a collecting device is located in the path of the composite stream 156. The collecting device may be a foraminous forming surface 158 (e.g., belt, drum, wire, fabric, etc.) driven by rollers 160 and that is rotating as indicated by the arrow 162. The merged streams 156 of meltblown fibers and staple fibers are thereby collected forming a coherent composite nonwoven web 154. A vacuum box 162 is desirably employed to assist in drawing the composite stream onto the forming surface 158 and removing the entraining air. The resulting nonwoven web 154 is coherent and may be removed from the forming surface 158 as a self-supporting nonwoven material and thereafter further processed and/or converted as desired.

Fibers and Composite Webs

As noted above, the nonwoven webs may include staple length fibers and such fibers may comprise synthetic fibers, natural fibers or combinations thereof. A wide variety of staple fibers are commercially available and the present invention is not believed limited with respect to the particular fiber selected. Selections may be made, as is known to those skilled in the art, in order to achieve the desired web properties, cost and so forth.

In certain applications it may be desirable for the staple fibers to comprise absorbent fibers such as, for example, cellulosic fibers. The cellulosic fibers may comprise traditional paper making fibers including woody fibers such as those obtained from deciduous and coniferous trees, including, but not limited to, softwood fibers, such as pine, fir, and spruce, and also hardwood fibers, such as eucalyptus, maple, birch, and aspen. Other papermaking fibers that can be used in the present disclosure include paper broke or recycled fibers and high yield fibers. Various pulping processes believed suitable for the production of cellulosic fibers include bleached chemithermomechanical pulp (BCTMP), chemithermomechanical pulp (CTMP), pressure/pressure thermomechanical pulp (PIMP), thermomechanical pulp (TMP), thermomechanical chemical pulp (TMCP), high yield sulfite pulps, and high yield Kraft pulps. Debonded fluff pulps are particularly well suited for use in the present invention. In addition, the cellulosic fibers may comprises non-woody fibers, such as cotton, abaca, bamboo, kenaf, sabai grass, flax, esparto grass, straw, jute hemp, bagasse, milkweed floss fibers, pineapple leaf fibers and so forth. Still further, the cellulosic fibers may comprise synthetic fibers derived from cellulosic materials such as, for example, viscose, Rayon, lyocell or other comparable fibers. Moreover, if desired, secondary fibers obtained from recycled materials may be used, such as fiber pulp reclaimed from sources such as, for example, newsprint, paperboard, office waste, etc. The fibrous sheet material can comprise a single variety of cellulosic fibers or alternatively can comprise mixture of two or more different cellulosic fibers. As is known in the art, it is often desirable to employ mixtures of fibers especially when utilizing recycled or secondary fibers. Regardless of the origin of the wood pulp fiber, the wood pulp fibers preferably have an average fiber length greater than about 0.2 mm and less than about 3 mm, such as from about 0.35 mm and about 2.5 mm, or between about 0.5 mm to about 2 mm or even between about 0.7 mm and about 1.5 mm.

With respect to synthetic fibers, a wide variety of polymers may be used, such as polyolefins including for example ethylene, propylene, and butylene polymers and blends and combinations thereof. In certain embodiments, the synthetic fibers may comprise polytetrafluoroethylene; polyesters, e.g., polyethylene terephthalate and so forth; polyvinyl acetate; polyvinyl chloride acetate; polyvinyl butyral; acrylic resins, e.g., polyacrylate, polymethylacrylate, polymethylmethacrylate, and so forth; polyamides, e.g., nylon; polyvinyl chloride; polyvinylidene chloride; polystyrene; polyvinyl alcohol; polyurethanes; polylactic acid; and so forth. The polymeric composition may comprise a blend or mixture of two or more different polymers and include various additives and fillers as is known in the art. Further, the fibers may comprise monocomponent, multicomponent or multiconstituent fibers. The synthetic staple fibers can have fiber length greater than about 0.2 mm including, for example, having an average fiber size between about 0.5 mm and about 50 mm or between about 0.75 and about 30 mm or even between about 1 mm and about 25 mm.

The second fibers, although different from the first fibers in one or more respects, may likewise comprise synthetic staple fibers such as those described herein above. Alternatively, the second fibers may be continuous fibers such as those formed from meltblowing, spunbonding or other fiber formation processes. The continuous fibers may also comprise polymers similar to those described above with respect to the synthetic staple fibers. With respect to the formation of meltblown fibers, the use of propylene polymers is particularly preferred as offering a good balance of properties at relatively low cost. By way of example only, various polymers suitable for use in the manufacture of the thermoplastic nonwoven fibers include, but are not limited to, those described in U.S. Pat. No. 7,467,447 to Thomas, U.S. Pat. No. 9,194,060 Westwood, U.S. Pat. No. 9,260,808 to Schmidt et al. and so forth.

In certain embodiments, the nonwoven web can include at least about 30% of the first fibers. For example, the first fibers, such as staple fibers, can comprise between about 25 and 90%, or between about 35 and 85% or even between about 45% and about 80% of the nonwoven web. Further, in certain embodiments, the second fibers, can comprise at least about 10% of the nonwoven web. For example, in certain embodiments the first fibers, such as continuous fibers, may comprise between about 10% to about 75%, or between about 15% ad about 65% or even between about 55% and about 20% of the nonwoven web. Generally speaking, the overall basis weight of such composite nonwoven web can be in the range of from about 10 gsm ($g/M^2$) to about 350 gsm, or from about 17 gsm to about 250 gsm, or even from about 25 gsm to about 150 gsm.

In practicing the present invention it is possible to achieve nonwoven webs having a higher MD and/or CD tensile strength as compared to nonwoven webs made without the use of the vortex generator. Further, in certain embodiments, the use of the vortex generator can result in a nonwoven web having zones of distinct basis weights extending in the MD; i.e. a nonwoven web having parallel alternating first and second zones extending in the MD wherein the first zone has a higher average basis weight than the second zone. For example, the first zone (relative to that of the second zone) may contain a higher percentage and amount of the first fibers. For example, the nonwoven fabric can have first regions or zones extending in the MD with an average basis weight at least about 5% higher than that of the second region and in certain embodiments can have an average basis weight between about 5%-20%, or even between about 5-15% greater than that of the second zone. In certain embodiments, the composite nonwoven web formed has first zones extending in the MD and second zones extending in the MD wherein the first zone has both a higher basis weight than the second zone and a higher percentage of the first fibers, e.g. staple or pulp fibers, than the second zone.

Optionally, the nonwoven web may be treated in one or more additional ways as desired. For example, surfactants may be applied to the web in order to improve the ease with which water penetrates the web. Additionally and/or alternatively, the nonwoven web may be treated to impart aesthetically pleasing and/or texture enhancing patterns to the nonwoven web. For example, the nonwoven web may be treated by one or more embossing or bonding techniques known in the art that impart localized compression and/or bonding corresponding to one or more desired patterns. In this regard, the base sheet can be embossed by the application of localized pressure, heat, and/or ultrasonic energy. As further options, the nonwoven webs may, additionally or alternatively, be treated by various other known techniques such as, for example, stretching, needling, creping, and so forth. Still further, the nonwoven web may optionally be plied with and/or laminated to one or more additional materials or fabrics.

Materials formed by the current process and techniques of the present invention have a wide array of applications. By way of example, the composite nonwoven webs may comprise a wiper including for example a skin cleaning washcloth or wipe (e.g. face, hands or perineal cleaning) or a hard surface wipe. In a further application, the composite nonwoven webs of the present invention can be used as an absorbent layer in a personal care absorbent article including for example within a feminine care liner, diaper, incontinence garment, bib, sweatband, bandage and so forth.

EXAMPLES

Composite nonwoven webs, consisting of a mixture of polypropylene meltblown fibers and softwood wood pulp fibers, were made using the process as described in U.S. Pat. No. 8,017,534 to Harvey et al. The resulting nonwoven webs had a fiber ratio of 70:30 wood pulp fiber to meltblown fiber. Samples were made using a vortex generator having a triangular wave pattern of either "small" triangular shaped tabs (1.4 cm width, 0.7 cm height) or with "large" triangular shaped tabs (2.5 cm width, 1.3 cm height). Samples were also made having tabs on the opposed CD extending chute walls either aligned (i.e. tab peaks of the opposed vortex generators were aligned in the MD) or offset (i.e. tab peaks of one vortex generator aligned in the MD with the troughs of the opposed vortex generator). Samples were also made with the tab angle either at 0 degrees (i.e. where the tab was parallel with the chute walls) or at 45 degrees (i.e. where the tabs are angle inwardly towards and slightly into the fiber flow). In all instances the base of the tabs were flush with the chute walls. The control was run without any vortex generator.

| Example | Tabs | Tab Angle | Tab Alignment (MD) | Mean CD Peak Load (gf) | Mean MD Peak Load (gf) |
|---|---|---|---|---|---|
| A | Small | 0° | Aligned | 216.8 | 738.5 |
| B | Small | 45° | Aligned | 197.3 | 748.6 |
| C | Small | 0° | Offset | 195.0 | 675.3 |
| D | Small | 45° | Offset | 192.4 | 769.6 |
| E | Large | 0° | Aligned | 193.4 | 721.2 |
| F | Large | 45° | Offset | 195.3 | 759.6 |
| G | Control | — | — | 179.1 | 687.5 |

The control and inventive samples all had comparable levels of softness. However, the use of the vortex generators provided an increase in MD and/or CD strength without degradation of softness. In addition, it is noted that Example E, and to a lesser extent Examples F and B, had visually discernable stripes with alternating regions having relatively higher and lesser amounts of pulp.

The composite nonwoven webs and the equipment and processes of making the same can, optionally, include one or more additional elements or components as are known in the art. Thus, while the invention has been described in detail with respect to specific embodiments and/or examples thereof, it will be apparent to those skilled in the art that various alterations, modifications and other changes may be made to the invention without departing from the spirit and scope of the same. It is therefore intended that the claims cover or encompass all such modifications, alterations and/or changes.

What is claimed is:

1. A method of making a composite nonwoven web comprising:

providing a chute having at least first and second opposed walls that extend in a cross-direction that define a passageway and passageway direction and further define an exit gap;

providing a series of spaced tabs extending outwardly from proximate the exit gap and further wherein adjacent the tabs are open spaces whereby air is allowed to flow sidewardly relative to the passageway direction;

entraining first fibers in a first stream of air and thereby forming a first stream of air-entrained fibers;

entraining second fibers in a second stream of air thereby forming a second stream of air-entrained fibers;

directing the first stream of air-entrained fibers through the passageway in the passageway direction;

directing the first stream of air-entrained first fibers through the exit gap and past the tabs thereby forming vortices in the first stream of air-entrained fibers; then directing the second stream of air-entrained fibers such that it impinges upon the first stream of air-entrained fibers wherein the second fibers and first fibers intermix and form a composite stream of air-entrained fibers;

providing a moving forming surface under the exit gap;

depositing the composite stream of air-entrained fibers onto the forming surface thereby forming a nonwoven web.

2. The method of claim 1 wherein the velocity of the first stream of air-entrained fibers within the chute is greater than 50 M/second.

3. The method of claim 1 wherein the tabs have a height between about 0.2 and about 4 cm.

4. The method of claim 3 wherein the center to center distance of the tabs is between about 0.4 and about 10 cm.

5. The method of claim 1 wherein the series of tabs and open spaces form a crenulate.

6. The method of claim 1 wherein the tabs have a triangular shape.

7. The method of claim 1 wherein the series of spaced tabs extends along at least 60-100% of at least one of the first and second walls.

8. The method of claim 1 wherein the series of spaced tabs extend along at least 60-100% of both of the first and second walls.

9. The method of claim 8 wherein the series of spaced tabs are positioned beneath the entire CD length of both of said first and second walls.

10. The method of claim 8 wherein the tabs adjacent the opposed first and second walls are offset relative to one another in the machine direction.

11. The method of claim 8 wherein the tabs adjacent the opposed first and second walls are aligned with one another in the machine direction.

12. The method of claim 1 wherein the first fibers have an average length of between about 0.2 and about 3 mm.

13. The method of claim 12 wherein the first fibers comprise cellulosic fibers.

14. The method of claim 12 wherein the second fibers comprise thermoplastic polymer and are semi-molten when the second stream of air-entrained fibers impinges upon and mixes with the first stream of air-entrained fibers.

15. The method of claim 1 wherein the greater intermixing of the first and second streams of fibers occurs regionally whereby first fibers are regionally driven deeper into the stream of second fibers and wherein the nonwoven web formed on the forming surface has alternating first and second rows, extending in the machine direction, whereby the first region has a greater weight percentage of first fibers than the second region.

16. The method of claim 15 wherein the first rows contain at least 5% more first fibers than the second rows.

17. The method of claim 1 wherein the first fibers comprise staple length fibers and the second fibers comprise continuous fibers.

18. The method of claim 1 wherein the tabs extend at an angle +/−45 degrees relative to the passageway direction.

19. The method of claim 1 wherein the tabs do not extend directly beneath the passageway.

20. The method of claim 1 wherein the tabs are flush with an inner wall of the first or second wall and further wherein the tabs are angled away from the passageway.

* * * * *